US006036574A

United States Patent [19]

Halford

[11] Patent Number: 6,036,574

[45] Date of Patent: Mar. 14, 2000

[54] CHARGER/LAUNCHER FOR FAST RECHARGE TOY VEHICLE

[75] Inventor: Wayne Halford, Hermosa Beach, Calif.

[73] Assignee: Mattel, Inc., El Segundo, Calif.

[21] Appl. No.: 08/700,623

[22] Filed: Aug. 16, 1996

[51] Int. Cl.[7] ..... A63H 29/24

[52] U.S. Cl. ..... 446/429; 446/457; 446/484

[58] Field of Search ..... 446/429, 441, 446/457, 462, 484

[56] References Cited

U.S. PATENT DOCUMENTS

| | | | |
|---|---|---|---|
| 3,471,963 | 10/1969 | Tomiyama | 446/429 |
| 3,789,540 | 2/1974 | Convertine et al. | 446/429 |
| 3,958,361 | 5/1976 | Cooper et al. | 446/429 |
| 3,970,309 | 7/1976 | Sato | 446/429 |
| 3,986,717 | 10/1976 | Kirby et al. | 446/429 |
| 4,433,504 | 2/1984 | Terui | 446/429 |
| 5,460,560 | 10/1995 | Liu | 446/429 |

FOREIGN PATENT DOCUMENTS

| | | | |
|---|---|---|---|
| 62-40622 | 10/1987 | Japan . | |
| 2060415 | 5/1981 | United Kingdom | 446/429 |

*Primary Examiner*—Robert A. Hafer
*Assistant Examiner*—Jeffrey D. Carlson
*Attorney, Agent, or Firm*—Roy A. Ekstrand

[57] ABSTRACT

A toy vehicle is operatively driven by an electric motor having a storage capacitor coupled in parallel therewith. The capacitor and motor are coupled to a pair of underside contacts on the toy vehicle for charging. The toy vehicle underside further includes an aperture and an elongated slot. A cooperating charger/launcher includes a vehicle receiving surface upon which a wheel pedestal is positioned between the area at the rear of the vehicle for raising the vehicle rear wheels. The charger/launcher further includes an interlock post received within the aperture formed on the vehicle undersurface and a safety rib received within the elongated slot of the vehicle. A pair of electrical contacts are positioned on each side of the protective rib and are coupled to a battery supply within the launcher for charging the vehicle capacitor.

5 Claims, 2 Drawing Sheets

CHARGER/LAUNCHER FOR FAST RECHARGE TOY VEHICLE

FIELD OF THE INVENTION

This invention relates generally to rechargeable electrically powered toy vehicles and particularly to the charger and launcher apparatus used therein.

BACKGROUND OF THE INVENTION

Rechargeable toy vehicles have been provided for many years and have, for the most part, enjoyed substantial commercial success. Usually, such toy vehicles includes a rechargeable battery supported within the toy vehicle together with a small DC motor which is operatively coupled to one or more of the toy vehicle vehicles to power the toy vehicle. Often a track or race course is provided for use with such rechargeable toy vehicles. To further reduce the cost and complexity as well as size of such electrically powered toy vehicles, playsets often further utilize vehicles without steering capability and rely upon raised side walls formed on the track portions to confine the vehicle within the track circuit. As a result, the electrically powered toy vehicle rapidly circulates upon the track being guided by the raised side walls and maintained within the track circuit or loop. Most such toy vehicles require a substantial time period for battery charging and often interchangeable or replaceable batteries are utilized.

A recently developed electrically powered toy vehicle has improved the recharge time of electrically powered toy vehicles in that it utilizes a toy vehicle having a large capacitor in parallel with the electric motor. The capacitor and motor in parallel combination are coupled to a pair of charging terminals extending downwardly from the vehicle lower surface. The motor is directly coupled to the drive wheels of the vehicle without the aid of intervening clutch mechanism. Thus, the vehicle wheels turn in combination with the rotation of the electric motor. The charger/launcher for such capacitively powered electric toy vehicle utilizes a receiving surface for resting the vehicle thereon together with a pedestal at the rear portion of the vehicle which raises the vehicle wheels off the launcher surface. A pair of electrical contacts extend upwardly from the launcher surface and are aligned with the corresponding terminals of the toy vehicle such that electrical connection is made between the launcher and the vehicle when the toy vehicle rests upon the launcher. The extending contacts of the launcher are coupled to a plurality of batteries supported within the launcher.

Thus, when the toy vehicle is rested upon the launcher with the rear wheels raised above the launcher surface and such that contact is made with the launcher battery supply, the capacitor within the toy vehicle is rapidly charged. Because of the direct clutchless coupling of the motor to the drive wheels, the rear wheels of the vehicle spin in the air above the launcher surface during the charging process. Once the capacitor has been sufficiently charged, the vehicle is moved forwardly on the launch surface allowing the rear wheels to come into contact with the launcher surface and permitting the vehicle to propel itself from the launcher and onto the track. The stored energy within the capacitor supplies electrical power to the vehicle motor allowing the toy vehicle to complete one or more circuits of the track.

Despite the commercial appeal of such capacitively powered toy vehicles, several difficulties have been found which limit the feasibility and commercial attractiveness as well as the safety of such toy vehicle playsets. Most particularly, the extending contacts on the launcher surface are easily shorted by metal objects such as a coin or the like placed upon the surface bridging the contacts. This may cause damage to the batteries of the launcher and potentially could cause harmful explosion of the batteries. In addition, it has been found that the ability of the child user to apply the vehicle to the launcher in a reverse position thereby reversing the electrical connection polarity is also undesired. In this instance, the charging capacitor within the toy vehicle is subject to the wrong polarity of charging voltage and severe damage and, in some instances, potential explosion of the capacitor may result.

For these reasons, a continuing need in the art arises for a more improved capacitively powered toy vehicle and launcher combination which overcomes the limitations and shortcomings of the prior art devices of the capacitor may result.

For these reasons, a continuing need in the art arises for a more improved capacitively powered toy vehicle and launcher combination which overcomes the limitations and shortcomings of the prior art devices.

SUMMARY OF THE INVENTION

Accordingly, it is a general object of the present invention to provide an improved charger/launcher for fast recharge toy vehicles. It is a more particular object of the present invention to provide an improved charger/launcher for fast recharge toy vehicles which provides greater safety of operation in preventing reverse polarity and short circuit damage to the vehicle and the charger/launcher.

In accordance with the present invention, there is provided a charger/launcher for use in combination with a toy vehicle having a capacitor and electric motor drive together with a pair of underside vehicle contacts, the charger/launcher comprising: a base defining a vehicle-receiving surface having a pair of spaced-apart apertures formed therein; an elongated rib extending upwardly from the vehicle-receiving surface between the spaced-apart apertures; and an interlock post extending upwardly from the vehicle-receiving surface and positioned forward of the elongated rib.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
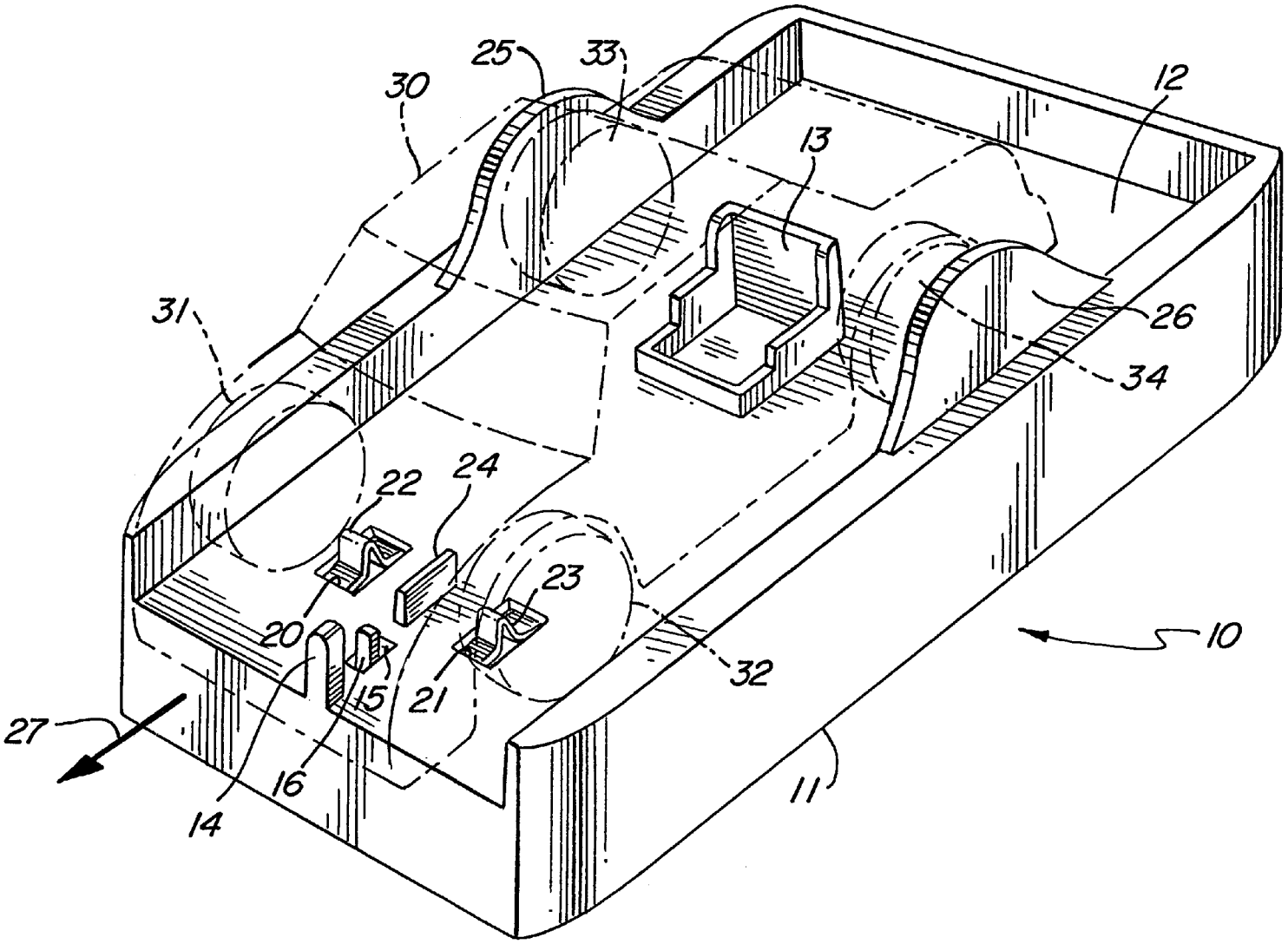
FIG. 1 sets forth a perspective view of a charger/launcher for fast recharge toy vehicles constructed in accordance with the present invention and showing a dashed-line outline of a cooperating rechargeable toy vehicle.
Figure 2:
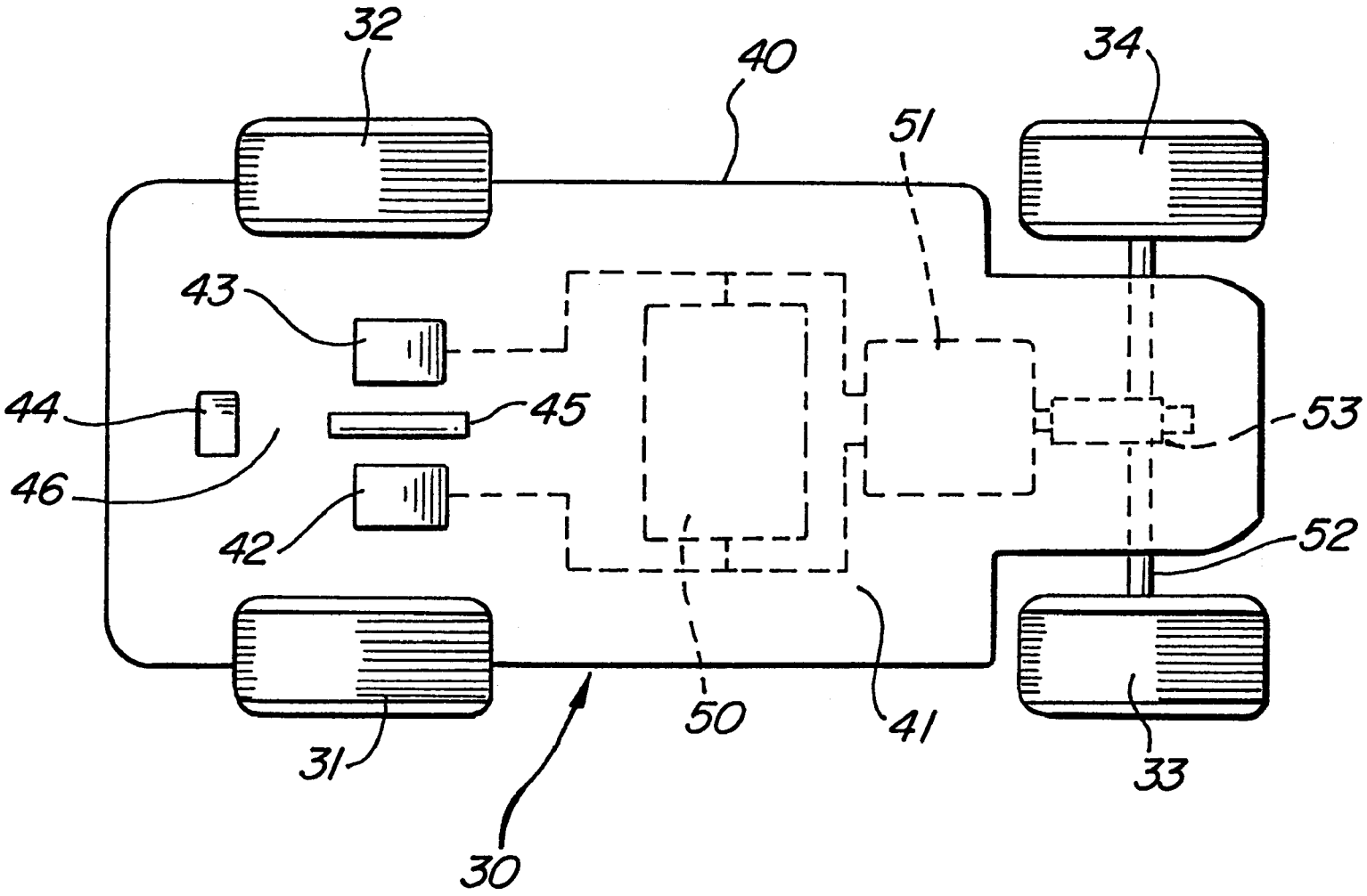
FIG. 2 sets forth a bottom view of a fast recharge toy vehicle of the type utilized in the present invention charger/launcher.

FIG. 1 sets forth a perspective view of a charger/launcher constructed in accordance with the present invention and generally referenced by numeral 10. Also shown in FIG. 1 in dashed outline is a simplified view of a toy vehicle cooperating with the present invention charger/launcher which, as is better seen in FIG. 2, is powered by the combination of a charging capacitor and electric motor. For purposes of illustration in FIG. 1, toy vehicle generally referenced by numeral 30 is in dashed outline to facilitate the observation and illustration of charger/launcher 10. Charger/launcher 10 includes a base 11 defining a vehicle receiving surface 12 and a pair of upwardly extending shields 25 and 26. The forward portion of surface 12 is open and supports an upwardly extending interlock post 14. Surface 12 of base 11 further defines an aperture 15 aligned with interlock post 14 and a pair of spaced apart elongated apertures 20 and 21. An elongated raised protective rib 24 is aligned with aperture 15 and interlock post 14 and is positioned between apertures 20 and 21. Base 11 further defines a vehicle wheel pedestal 13 configured to cooperate with the underside of toy vehicle 30 to raise the rear wheels of toy vehicle 30 when the toy vehicle is received upon charger/launcher 10. Suffice it to note here that toy vehicle 30 includes front wheels 31 and 32 and rear wheels 33 and 34. It should be further noted as is set forth below in greater details that rear wheels 33 and 34 comprise the power driven wheels of toy vehicle 30.

A pair of spring supported contacts 22 and 23 are supported within base 11 by conventional fabrication means and extend upwardly through apertures 20 and 21 respectively on either side of protective rib 24. In accordance with an important aspect of the present invention, rib 24 extends above contacts 22 and 23. A spring switch 16 extends upwardly through aperture 15 and is utilized in providing a safety interlock switch for charger/launcher 10 which interrupts the power coupling to contacts 22 and 23 in the absence of a toy vehicle upon surface 12.

In the anticipated use of the present invention charger/launcher, a toy vehicle 30 is received upon vehicle receiving surface 12 such that a pair of underside electrical contacts are aligned with and brought into contact with spring contacts 22 and 23. As described below in greater detail, an aperture formed on the underside of vehicle 30 (aperture 44 in FIG. 2) receives interlock post 14 to maintain the position of toy vehicle 30 upon wheel pedestal and surface 12 during the charging process. Because the rear wheels of toy vehicle 30 rotate when electrical power is coupled to the vehicle, wheel pedestal 13 raises wheels 33 and 34 upwardly from surface 12 to maintain vehicle 30 within the charger/launcher. As is also set forth below in greater detail, the undersurface of vehicle 30 defines an elongated slot 45. Slot 45 receives protective rib 24 during the charging process to allow the undersurface contacts of vehicle 30 to fully engage spring contacts 22 and 23.

Finally, the undersurface of toy vehicle 30 forces spring switch 16 downwardly completing the charging circuit within charger/launcher 10 and allowing electrical energy to flow through contacts 22 and 23 charging the vehicle capacitor in preparation for operation.

In accordance with an important aspect of the present invention, the combination of interlock post 14 and protective rib 24 prevents a flat object such as a coin or the like placed upon the area of charger/launcher 10 which supports contacts 22 and 23 from simultaneously touching both spring contacts. Thus, the inadvertent or mischievous shorting of spring contacts 22 and 23 by a coin or similar flat object is prevented. In further accordance with the present invention, the position of interlock post 14 and protective rib 24 cooperate to prevent a toy vehicle such as toy vehicle 30 from being placed in a reverse position upon charger/launcher 10. In this latter feature, and with temporary reference to FIG. 2, aperture 44 cooperates to ensure that a reverse direction vehicle cannot be actively placed upon the charger/launcher and provide electrical connection in reverse polarity.

FIG. 2 sets forth a bottom view of toy vehicle 30. Toy vehicle 30 includes a chassis 40 which supports front wheels 31 and 32 and a rear axle 52. Rear axle 52 in turn supports rear wheels 33 and 34. Chassis 40 defines a bottom surface 41 supporting a pair of extending electrical contacts 42 and 43. Bottom surface 41 further defines an aperture 44 and an elongated slot 45. A surface portion 46 extends between aperture 44 and slot 45. In accordance with the above-described capacitively driven toy vehicle known in the prior art, toy vehicle 30 includes a capacitor 50 electrically coupled to contacts 42 and 43 together with an electric motor 51 electrically connected in parallel with capacitor 50. Motor 51 in turn is coupled to a drive gear mechanism 53 which engages axle 52. Through the operation of drive gear mechanism 53, rotation of motor 51 causes a corresponding rotation of axle 52 and rear wheels 33 and 34 to drive toy vehicle 30.

In accordance with the present invention and as described above, aperture 44 receives interlock post 14 (seen in FIG. 1) when toy vehicle 30 is placed upon the charger launcher. As is also described above, slot 45 receives elongated protective rib 24 (seen in FIG. 1). The intervening surface portion 46 on bottom surface 41 of toy vehicle 30 forces spring switch 16 downwardly (seen in FIG. 1) to turn on the charging circuit within the charger/launcher.

It should be noted that the present invention provides additional safety features not found in the prior art charger/launcher and toy vehicle combination described above in the Background of the Invention. It will be understood that, except for the addition of safety elements which comprise protective rib 24, interlock post 14 and spring switch 16 on charger/launcher 10 (seen in FIG. 1) together with cooperating aperture 44 and slot 45 (seen in FIG. 2); the remaining fabrication of both charger/launcher 10 and toy vehicle 30 correspond to the prior art capacitively driven toy vehicle described above in Applicant's Background of the Invention. In accordance with the present invention, the added safety and protective elements thus provided ensure the safe and effective operation of the charger/launcher and its cooperating toy vehicle.

What has been shown is a charger/launcher for fast recharge toy vehicles which includes safety features protecting both the charger/launcher and the cooperating toy vehicle against inadvertent or mischievous damage due to reverse position of the vehicle upon the charger/launcher or placement of a conductive element such as a coin upon the charger/launcher contact region. The safety features thus provided protect against damage to the launcher battery supply and the capacitor storage device within the toy vehicle.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A charger/launcher in combination with a toy vehicle, said charger/launcher in combination with a toy vehicle comprising:

a toy vehicle having a capacitor and electric motor drive, a pair of underside vehicle contacts and a clearance slot therebetween;

a charger/launcher base defining a vehicle-receiving surface having a pair of spaced-apart apertures formed therein;

a pair of spring contacts extending upwardly through said pair of spaced-apart apertures and contacting said vehicle contacts;

an elongated rib extending upwardly from said vehicle-receiving surface between said spaced-apart apertures for preventing a flat conductive object from simultaneously touching both of said spring contacts; and an interlock post extending upwardly from said vehicle-receiving surface and positioned forward of said elongated rib, said toy vehicle resting upon said vehicle-receiving surface during recharge such that said vehicle contacts touch said spring contacts and said elongated rib extends into said clearance slot.

2. A charger/launcher in combination with a toy vehicle as set forth in claim 1 wherein said toy vehicle includes an aperture for receiving said interlock post.

3. A charger/launcher as set forth in claim 2 wherein said toy vehicle includes a pair of rear drive wheels.

4. A charger/launcher as set forth in claim 3 wherein said charger/launcher base further defines a wheel pedestal and wherein said toy vehicle defines an underside surface, said wheel pedestal being of sufficient height to contact said vehicle undersurface and raise said rear drive wheels from said vehicle-receiving surface.

5. A charger/launcher as set forth in claim 4 wherein said charger/launcher base further includes a depressible switch interposed between said interlock post and said elongated rib for energizing said contacts solely when said toy vehicle is placed upon said vehicle-receiving surface.

* * * * *